United States Patent [19]

Robinson et al.

[11] Patent Number: 4,872,611

[45] Date of Patent: Oct. 10, 1989

[54] VENTURI-LESS WATER NOZZLE

[75] Inventors: Alan S. Robinson, El Monte; Mark W. Fuller, Studio City, both of Calif.

[73] Assignee: Wet Enterprises, Inc., Universal City, Calif.

[21] Appl. No.: 256,121

[22] Filed: Oct. 11, 1988

Related U.S. Application Data

[63] Continuation of Ser. No. 48,563, May 11, 1987, abandoned.

[51] Int. Cl.[4] ..... F21P 7/00; B05B 1/14

[52] U.S. Cl. ..... 239/18; 239/17; 239/553.5; 239/590.5

[58] Field of Search ..... 239/17, 18, 590, 590.5, 239/553, 553.5

[56] References Cited

U.S. PATENT DOCUMENTS

| | | | |
|---|---|---|---|
| 634,569 | 10/1899 | Brainard | 239/17 |
| 3,640,472 | 2/1972 | Hruby, Jr. | 239/17 X |
| 3,705,686 | 12/1972 | Hruby, Jr. | 239/18 X |
| 3,782,629 | 1/1974 | Hruby, Jr. | 239/17 |
| 3,784,101 | 1/1974 | Frempter | 239/17 |

FOREIGN PATENT DOCUMENTS

| | | | |
|---|---|---|---|
| 1186278 | 10/1985 | U.S.S.R. | 239/17 |

*Primary Examiner*—Andres Kashnikow
*Assistant Examiner*—Patrick N. Burkhart
*Attorney, Agent, or Firm*—Blakely, Sokoloff, Taylor & Zafman

[57] ABSTRACT

The present invention comprises a venturi- and snorkel-less water fountain nozzle that creates low mounds of flowing water for water fountain displays. Instead of incorporating a venturi and snorkel like prior art nozzles, the present invention features an inverted cone dispersion element mounted partially within the nozzle that accelerates water flowing through the nozzle and directs it radially outwards to produce the appearance of a mound. The nozzle is typically submerged under $\frac{1}{2}$ to $\frac{3}{4}$ inches of water. The appearance of the mound can be varied by varying the depth of submergence of, or the flow rate of water through the nozzle.

16 Claims, 4 Drawing Sheets

FIG. 5

CONDITIONS 1/4" SUBMERGENCE

| DESCRIPTION | PRESSURE (LBS.) | HT. DISPLAY (IN.) | DIA. DISPLAY (IN.) |
|---|---|---|---|
| 30 GPM | 0 | 2-3 | 6 |
| 40 GPM | 0 | 5-6 | 8 |
| 50 GPM* | 1 | 6-7 | 10 |
| 60 GPM | 1 | 9-10 | 12-14 |
| 70 GPM | 1 | 10-12 | 14-16 |
| 80 GPM | 1.5 | 12-15 | 16-18 |
| 90 GPM | 2 | 18-21 | 16-18 |
| 100 GPM* | 2.5 | 25-28 | 18-20 |
| 110 GPM | 3 | 30-36 | 18-24 |
| 120 GPM | 3.5 | 42-46 | 24-28 |
| 130 GPM | 4 | 46-48 | 24-28 |
| 140 GPM | 5 | 56-60 | 24-30 |
| 150 GPM* | 6 | 68-72 | 30-32 |
| 160 GPM | 7 | 84 | 36-40 |
| 170 GPM | 7.5 | 96 | 40-48 |
| 180 GPM | 10.5 | 144 | 66 |
| 190 GPM | 13 | 168 | 84 |
| 200 GPM* | 15 | 180 | 120 |

FIG. 6

CONDITIONS 1/2" SUBMERGENCE

| DESCRIPTION | PRESSURE (LBS.) | HT. DISPLAY (IN.) | DIA. DISPLAY (IN.) |
|---|---|---|---|
| 30 GPM | 0 | 2 - 3 | 5-6 |
| 40 GPM | 0 | 3 | 6-7 |
| 50 GPM* | 1 | 5 - 6 | 8-9 |
| 60 GPM | 1 | 8 - 9 | 12 |
| 70 GPM | 1.5 | 12-14 | 12-14 |
| 80 GPM | 2 | 15-17 | 14-16 |
| 90 GPM | 2 | 21-22 | 18 |
| 100 GPM* | 2.5 | 24-27 | 18-20 |
| 110 GPM | 3 | 30-33 | 18-20 |
| 120 GPM | 3.5 | 36-40 | 20-24 |
| 130 GPM | 4 | 45-48 | 24-26 |
| 140 GPM | 5 | 54-57 | 24-30 |
| 150 GPM* | 6 | 66-69 | 30-32 |
| 160 GPM | 6.5 | 72-75 | 32-36 |
| 170 GPM | 7.5 | 84-87 | 36-40 |
| 180 GPM | 10 | 108-114 | 48 |
| 190 GPM | 12 | 144 | 60 |
| 200 GPM* | 15 | 168 | 84 |

FIG. 7

CONDITIONS 3/4" SUBMERGENCE

| DESCRIPTION | PRESSURE (LBS.) | HT. DISPLAY (IN.) | DIA. DISPLAY (IN.) |
|---|---|---|---|
| 30 GPM | 0 | 2-3 | 5-6 |
| 40 GPM | 0 | 3 | 6 |
| 50 GPM* | 0 | 5-6 | 7 |
| 60 GPM | 1 | 8-9 | 7-8 |
| 70 GPM | 1.5 | 12 | 8-9 |
| 80 GPM | 1.5 | 15-16 | 10-12 |
| 90 GPM | 2 | 19-20 | 12-14 |
| 100 GPM* | 2.5 | 23-24 | 14 |
| 110 GPM | 3 | 27-30 | 16 |
| 120 GPM | 3 | 30-36 | 16-18 |
| 130 GPM | 4 | 36-42 | 18-24 |
| 140 GPM | 4.5 | 42-48 | 18-24 |
| 150 GPM* | 5.5 | 48-54 | 24-30 |
| 160 GPM | 6 | 60 | 24-36 |
| 170 GPM | 7.5 | 60-72 | 30-40 |
| 180 GPM | 8.5 | 84 | 30-40 |
| 190 GPM | 13 | 144 | 48 |
| 200 GPM* | 17 | 168 | 60 |

VENTURI-LESS WATER NOZZLE

This is a divisional of application Ser. No. 07/048,563 filed May 11, 1987, now abandoned.

BACKGROUND OF THE INVENTION

1. Field of the Invention

The present invention relates to the field of water fountains, and more specifically, to a venturi-less nozzle for producing low mounds of aerated water.

2. Prior Art

Water fountains have long been treasured for their decorative and entertaining qualities. Fountains vary in size and complexity from small fountains with single streams of water to large outdoor or indoor fountains incorporating multiple water nozzles and sophisticated light displays. Such large fountains are typically installed in hotels, shopping malls, museums and parks.

Various kinds of nozzles and nozzle arrangements are commonly used in water fountains to produce different visual effects. One commonly produced effect is that of a low mound of aerated water. In the prior art, such low mounds of water are produced by venturi-type nozzles incorporating snorkels. In such a prior art nozzle, the nozzle is located several inches below the water surface of the fountain. Water flowing through the venturi creates a low pressure zone which sucks air through a snorkel that connects the venturi to the surface. This air mixes with the water flowing out the nozzle, causing the water, as it emerges from the water surface, to disperse into a relatively low (12" to 36") relatively flat mound of white, aerated water. Such mounds are especially attractive if illuminated with light from below.

A drawback of prior art low mound water nozzles is that their snorkels are unsightly, and are prone to clogging and vandalism.

BRIEF SUMMARY OF THE INVENTION

The present invention comprises a venturi- and snorkel-less water fountain nozzle that creates low mounds of flowing water for water fountain displays. Instead of incorporating a venturi and snorkel like prior art nozzles, the present invention features an inverted cone dispersion element mounted partially within the nozzle that accelerates water flowing through the nozzle and directs it radially outwards to produce the appearance of a mound. The nozzle is typically submerged under ½ to ¾ inches of water. The appearance of the mound can be varied by varying the depth of submergence of, or the flow rate of water through the nozzle.

BRIEF DESCRIPTION OF THE DRAWINGS

FIGS. 5, 6 and 7 are tables illustrating the performance of the preferred embodiment of the present invention at depths of submergence of ¼", ½" and ¾", respectively.

DETAILED DESCRIPTION OF THE INVENTION

A venturi-less water nozzle for producing low mounds of bubbling water in water fountains is disclosed. In the following description, for purposes of explanation, numerous details are set forth, such as specific materials, arrangements and proportions in order to provide a thorough understanding of the present invention. However, it will be apparent to one skilled in the art that the invention may be practiced without these specific details. In other instances, well known components, such as pipe fittings, have not been described in detail in order not to obscure the present invention unnecessarily.

Figure 1:
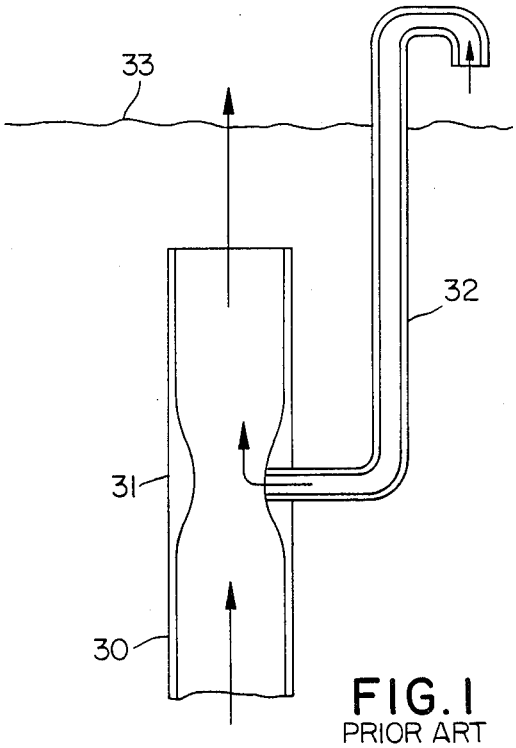
FIG. 1 PRIOR ART
FIG. 1 is a sectional view of a low mound water nozzle of the prior art.

Referring first to FIG. 1, this figure illustrates the venturi-type low mound water nozzle of the prior art. The prior art nozzle comprises a substantially straight pipe segment 30 containing a constricted venturi section 31. The bottom of pipe segment 30 (not shown) is coupled to a pressurized water supply line. The open top end of the pipe segment is situated several inches below water surface 33. A snorkel 32 connects the venturi section 31 to the air above the water surface 33.

The prior art nozzle functions as follows. Water from the water supply line enters the bottom of pipe segment 30 and flows through venturi 31. The resulting pressure drop in the venturi 31 causes air to be drawn through snorkel 32. This air mixes with the water flowing through the venturi 31 such that the flow that emerges from the top of pipe segment 30 is a bubbling mixture of air and water. When this mixed flow breaks through the water surface 33, it creates a low mound of bubbling, tumbling water.

Although the water mound produced by a nozzle of the prior art is visually satisfactory, the snorkel gives such a nozzle an ungainly physical configuration that makes installation of the nozzle quite awkward. The space requirements of the snorkel must also be taken into account in designing the layout of a fountain, and the long lever arm represented by the snorkel is prone to breakage, either accidentally, for instance during cleaning and maintenance of the fountain, or as the result of vandalism.

Figure 2:
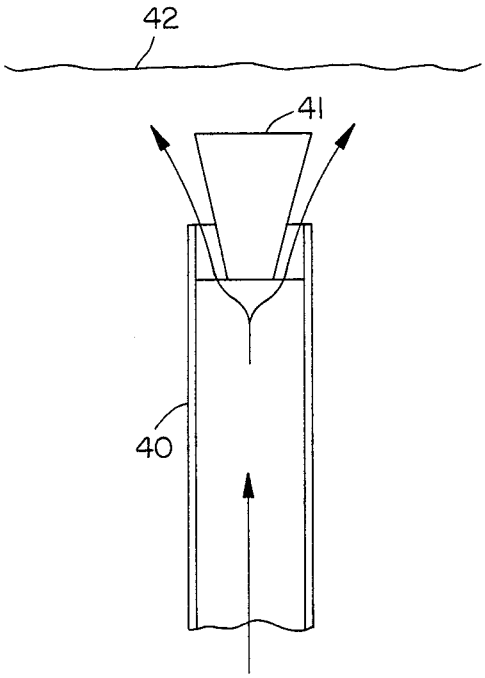
FIG. 2 is a sectional view of one embodiment of the present invention.

The present invention produces a mound of water visually similar to the mound produced by prior art venturi-type nozzles without their awkward appearance and sensitivity to damage. FIG. 2 illustrates the basic concept of the present invention. Instead of using a venturi and a snorkel, the nozzle of the present invention incorporates a dispersion element 41 mounted at the top, open end of a pipe segment 40. Pipe segment 40 may be a section of steel, brass, copper, galvanized, PVC, or other standard pipe, or may be specially made. Pipe segment 40 may have any desired length, and is preferably between 6 and 12 inches long. The bottom end of pipe segment 40 (not illustrated), which may be threaded or flanged, is connected by means of standard pipe fittings to a water supply line.

Dispersion element 41, which may be of the same material as the pipe segment 40, comprises a generally downwardly tapering element mounted such that its lower end protrudes partially into the top end of pipe segment 40. The lower end of dispersion element 41 is shaped such that the annular area between dispersion element 41 and pipe segment 40 through which the water flow decreases as the water approaches the top end of pipe section 40. This decreasing annular flow area causes the water to accelerates as it flows along the lower end of dispersion element 41 and emerges from the top of pipe segment 40. The flow is also directed in an outward direction, as illustrated by arrow 36 in FIG. 2. By properly adjusting the depth of submergence of the nozzle of the present invention, it has been found that the spray emerging from the fountain's water surface mixes with the air to produce an aerated mound that is almost identical in appearance to the mound produced by the venturi-type nozzle of the prior art. The exact submergence depth to produce the desired mound shape depends on the configuration and size of the nozzle's pipe section 40 and dispersion element 41. In most cases, however, it has been found that the proper submergence depth is on the order of one inch, which is significantly less than the 4 to 6 inches required for equivalent prior art nozzles. This smaller required submergence depth means that a shallower fountain pool can be used with the present invention than with prior art nozzles.

Figure 3:
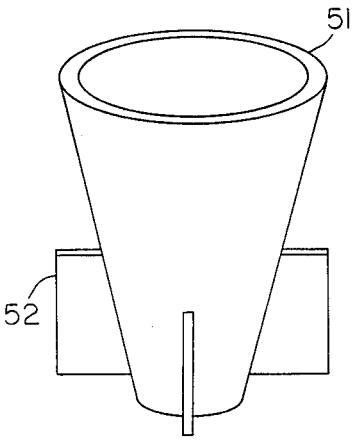
FIG. 3 is a perspective view of the preferred embodiment of the inverted cone of the present invention.
Figure 4:
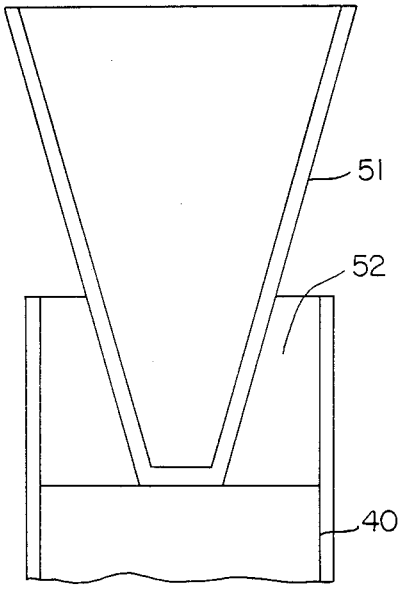
FIG. 4 is a detailed sectional view illustrating the attachment of the inverted cone to the pipe body in the preferred embodiment of the present invention.

The preferred embodiment of the dispersion element 41 is illustrated in FIG. 3. In this embodiment, dispersion element 41 comprises a hollow truncated cone 51, sealed at the bottom, and fitted with short radial fins 52 for attaching dispersion element 41 to pipe section 40. A sectional view of the preferred embodiment of the dispersion element 41 mounted to pipe section 40 is illustrated in FIG. 4. In the preferred embodiment, the truncated cone 51 is made of copper. It is three inches long, with an outside diameter of 2.19 inches at its top end and 0.56 inches at its bottom end, giving a ratio of the two diameters of approximately 0.25. The top end is open and the bottom end is sealed. Truncated cone 51 is outfitted with four equally spaced fins 52, which extend upward from the bottom of truncated cone 51 for a length of 1.37 inches, and radially outwards to a radial distance of one inch from the center of truncated cone 51. These dimensions allow dispersion element 41 to be mounted in a section of standard 2" copper pipe, which is used as the pipe section 40 of the preferred embodiment. The yields a ratio of the pipe diameter (2") to the diameter of the top end of the truncated cone (2.19") of approximately 0.9. Fins 52 may be attached to pipe section 40 by any appropriate fastening means, and in the preferred embodiment, they are soldered. With the top of the fins 52 even with the top of the pipe 40 as shown, the ratio of the length of the cone within the pipe (1.37") to the length of the cone extending above the pipe (3"−1.37"=1.63") of approximately 0.84, within the preferred range of 0.8 to 0.9. This also provides a ratio of the length of the truncated cone within the pipe (1.37") to the diameter of the pipe (2") of approximately 0.7.

It has been found that the preferred embodiment described above produces the most desirable result if it is submerged at a depth between $\frac{1}{4}$ and $\frac{3}{4}$ inches. FIGS. 5, 6, and 7 illustrate the performance of the preferred embodiment of the nozzle at various flow rates, pressures, and depths of submergence. It can be seen that for flow rates below about 60 gallons of water per minute, the width of the water display produced is greater than the display's height, while for higher flow rates the display tends to be higher than it is wide.

Accordingly, an improved water fountain nozzle is presented. The invention allows the creation of visually entertaining mounds of bubbling water without the cumbersome and fragile snorkel and venturi of prior art devices. Although specific details are described herein, it will be understood that various changes can be made in the materials, details, arrangements and proportions of the various elements of the present invention without departing from the scope of the invention. For example, although this specification refers mainly to metal components for the invention, other materials, such as plastic or fiberglass, may be used. The portion of the dispersion element with respect to the pipe section of the present invention can be made adjustable, thereby allowing variation in the nozzle's water spray pattern. Instead of using a pipe section of constant cross-section, pipe sections with tapered or otherwise shaped ends can be used in conjunction with variously shaped dispersion elements, or the dispersion element may be made interchangeable. Other variations will be apparent to those skilled in the art.

I claim:

1. A submergible nozzle for use in a water fountain, such water fountain comprising a pool of water having a water surface, said nozzle comprising:

a pipe means having a longitudinal axis, inside and outside surfaces, and first and second open ends, said first open end being attached to a water supply source;

a dispersion means disposed adjacent to said second open end of said pipe means, a first portion comprising a first length of said dispersion means being disposed within said second open end of said pipe means, and a second portion, comprising a second length of said dispersion means being disposed adjacent to said second open end of said pipe means, said pipe means and dispersion means being entirely located at a predetermined depth under said water surface during the operation of said nozzle;

said first portion of said dispersion means being shaped such that an annular space is formed between said first portion of said dispersion means and the inside surface of said pipe, said annular space decreasing in cross sectional area along a first direction running parallel to said longitudinal axis of said pipe from said first end of said pipe to said second end of said pipe, such that a flow of water from said water supply source, being split as it flows through said annular space, is accelerated by said decrease in annular cross-sectional area prior to emerging from said second end of said pipe;

said second portion of said dispersion element shaped such that said split flow of water emerging from said second end of said pipe is diverted radially outward away from said longitudinal axis of said pipe, said split flow forming an aeriated mound of flowing water that extends above said water surface, said aeriated mound of flowing water being produced by entrainment, in part, of water located in a portion of said pool of water directly above said dispersion means, said mound having a height and a width, the ratio of said height to said width being approximately between 0.4 and 3.0, said mound being characterized by its attractiveness when illuminated with light from below and the elimination of any unsightly adjacent apparatus.

2. The submergible nozzle of claim 1 wherein said pipe means comprises a substantially straight section of pipe having a pipe diameter.

3. The submergible nozzle of claim 2 wherein said dispersion means comprises a truncated cone, said cone having a first end having a first diameter and a second end having a second diameter, said first diameter being smaller than said second diameter, said first end comprising part of said first portion of said dispersion means and said second portion forming part of said second portion of said dispersion means.

4. The submergible nozzle of claim 3 wherein said truncated cone is hollow.

5. The submergible nozzle of claim 4 wherein said first end of said hollow truncated cone is closed and said second end of said hollow truncated cone is open.

6. The submergible nozzle of claim 5 wherein the ratio of said first diameter of said first end of said truncated cone to said second diameter of said second end of said truncated cone is approximately 0.25, and the ratio of said pipe diameter to said second diameter is approximately 0.9.

7. The submergible nozzle of claim 6 wherein the ratio of said first length of said dispersion means to said second length of said dispersion means is between 0.8 and 0.9.

8. The submergible nozzle of claim 7 wherein the ratio of said first length of said dispersion means to said pipe diameter is approximately 0.7.

9. The submergible nozzle of claim 1 further comprising mounting means for supporting said dispersion means adjacent to said pipe means.

10. The submergible nozzle of claim 9 wherein said mounting means comprise a plurality of fin means extending radially from said first portion of said dispersion means through said annular space to said inside surface of said pipe means.

11. The submergible nozzle of claim 1 wherein said nozzle is comprised of metal.

12. The submergible nozzle of claim 11 wherein said pipe means and said dispersion means are comprised substantially of the same metal.

13. The submergible nozzle of claim 12 wherein said metal is steel.

14. The submergible nozzle of claim 12 wherein said metal is copper.

15. The submergible nozzle of claim 12 wherein said metal is brass.

16. The submergible nozzle of claim 1 wherein said nozzle is comprised of a plastic material.

* * * * *

UNITED STATES PATENT AND TRADEMARK OFFICE

CERTIFICATE OF CORRECTION

PATENT NO. : 4,872,611
DATED : October 10, 1989
INVENTOR(S) : Robinson, et. al.

It is certified that error appears in the above-indentified patent and that said Letters Patent is hereby corrected as shown below:

Column 3, line 41, delete "The" insert --This--.

Column 4, line 7, delete "portion" insert --position--.

Signed and Sealed this

Twenty-sixth Day of April, 1994

*Attest:*

Bruce Lehman

BRUCE LEHMAN

*Attesting Officer*

*Commissioner of Patents and Trademarks*